US007812544B2

(12) United States Patent
Morales et al.

(10) Patent No.: US 7,812,544 B2
(45) Date of Patent: Oct. 12, 2010

(54) FLUORESCENT LIGHT CONTROL

(75) Inventors: Louis J. Morales, Somerville, MA (US); Gary W. Stevens, Somerville, MA (US); John B. Unger, West Islip, NY (US)

(73) Assignee: iSine, Inc., Ronkonkoma, NY (US)

( * ) Notice: Subject to any disclaimer, the term of this patent is extended or adjusted under 35 U.S.C. 154(b) by 327 days.

(21) Appl. No.: 12/082,817

(22) Filed: Apr. 14, 2008

(65) Prior Publication Data

US 2009/0256489 A1 Oct. 15, 2009

(51) Int. Cl.
*H05B 37/02* (2006.01)

(52) U.S. Cl. ..... 315/209 R; 315/246; 315/291; 315/360; 315/DIG. 4; 315/DIG. 5

(58) Field of Classification Search ..... 315/209 R, 315/224–226, 227 R, 244–247, 276, 283, 315/291, 307, 360, DIG. 2, DIG. 4, DIG. 5
See application file for complete search history.

(56) References Cited

U.S. PATENT DOCUMENTS 5,751,115 A * 5/1998 Jayaraman et al. ..... 315/225
6,172,466 B1 * 1/2001 Ki et al. ..... 315/224
7,667,408 B2 * 2/2010 Melanson et al. ..... 315/209 R

* cited by examiner

*Primary Examiner*—Thuy Vinh Tran
(74) *Attorney, Agent, or Firm*—Raymond J. Werner

(57) ABSTRACT

Circuitry, which is compatible with incandescent light dimmers, is disposed within the screwbase of a compact fluorescent light, and sets driving frequencies for a mercury plasma, based, at least in part, on sensing the duty cycle of the incoming AC supply waveform. In this way, existing lighting infrastructure, including phase-cut dimmer circuits for incandescent light bulbs, may be preserved, and incandescent bulbs can be replaced with compact fluorescent lights equipped with circuitry in accordance with the present invention. In a further aspect, the circuitry synchronizes the bulb drive signals with the AC power line frequency.

16 Claims, 5 Drawing Sheets

A = true when V > +40
B = true when V < -40
C = true when V > +10 or V < -10
N = # of output switch cycles
M = requested dimming level
T = output switch period
Vfb = A/D value @ specific cycle A = true when V > +40
B = true when V < -40
C = true when V > +10 or V < -10
N = # of output switch cycles
M = requested dimming level
T = output switch period
Vfb = A/D value @ specific cycle

FLUORESCENT LIGHT CONTROL

FIELD OF THE INVENTION

The present invention relates generally to fluorescent light bulbs, and more particularly relates to circuitry for dimming in the operation of fluorescent light bulbs.

BACKGROUND

The well-known electric light bulb, or incandescent light bulb, has had a monumental impact on modern society. The ability to conveniently illuminate areas without sunlight has enabled a vast range of human activities.

Subsequent to the development of the incandescent light bulb, another lighting element, the fluorescent light bulb, was developed.

With both incandescent and fluorescent lighting elements to choose from, a pattern emerged in which incandescent lighting tended to be used by non-industrial, non-institutional consumers, typically in the home environment, while fluorescent lighting tended to be selected by large users of lighting, typically in industrial or institutional environments (e.g., businesses and schools). Fluorescent lights have historically been available in the form of long tubes, as compared to the much smaller form factor of the incandescent light bulb. However, fluorescent lighting was, and is, attractive to its users because, generally, a greater amount of light can be obtained from fluorescent lights per unit of energy consumed, as compared to incandescent lights. Although fluorescent lighting elements may be more energy efficient than incandescent lighting, consumers have preferred incandescent lights for a variety of reasons including, but not limited to, initial cost, color temperature, and small form factor.

In more recent times, the ability to reduce energy consumption has become increasingly important. Concurrently with greater demand for energy reduction technologies, small form factor fluorescent lighting elements have been introduced to the consumer marketplace. Such a small form factor fluorescent light bulb may also be referred to as a compact fluorescent light (CFL). Many compact fluorescent bulbs feature integral ballasts, or circuitry, so that these bulbs may be used in the same sockets into which conventional incandescent bulbs fit. In other words, compact fluorescent lights typically include a screwbase that fits existing incandescent light bulb sockets, and that screwbase includes the necessary ballast circuitry to operate the fluorescent bulb. By enabling direct physical replacement of incandescent bulbs, compact fluorescent bulbs have reduced the barriers to acceptance by consumers. Given the desire to reduce energy consumption and the ease of making the switch to compact fluorescent lighting, the volume of these lighting elements sold into the consumer market is expected to increase rapidly.

One disadvantage of direct physical replacement of incandescent light bulbs with compact fluorescent lights is that compact fluorescent lights are not compatible with the dimmer controls that form a part of the vast installed base of incandescent lighting infrastructure.

What is needed are methods and apparatus for providing compact fluorescent lights that are compatible with incandescent lighting infrastructure including the conventional dimmer circuits originally intended for use with incandescent light bulbs.

SUMMARY OF THE INVENTION

Briefly, control circuitry for fluorescent light bulbs provides features including, but not limited to, dimming. Means are provided for receiving dimmer control information in the phase cut format used by dimmer switches for incandescent light bulbs, and, responsive thereto, modifying the fluorescent bulb drive signals to achieve a dimming level corresponding to the dimming level information received from the incandescent dimmer switch.

In a further aspect, a period is determined, and the fluorescent bulb drive signals are generated such that in an amount of time substantially equal to that of the aforementioned period, a first burst of pulses at a first frequency is provided and a signal at a first level is provided; and subsequently, in an amount of time substantially equal to that of the period, a second burst of pulses at the first frequency is provided, and a signal at a second level is provided.

In another aspect, various embodiments substantially synchronize the fluorescent bulb drive signals to the line voltage frequency.

In another aspect, power savings are achieved, while meeting the operational requirements of typical incandescent dimmer switches, by means of a pulsed current load disposed after a bridge rectifier, which replaces a resistor disposed across the input line voltage.

DETAILED DESCRIPTION

Figure 1:
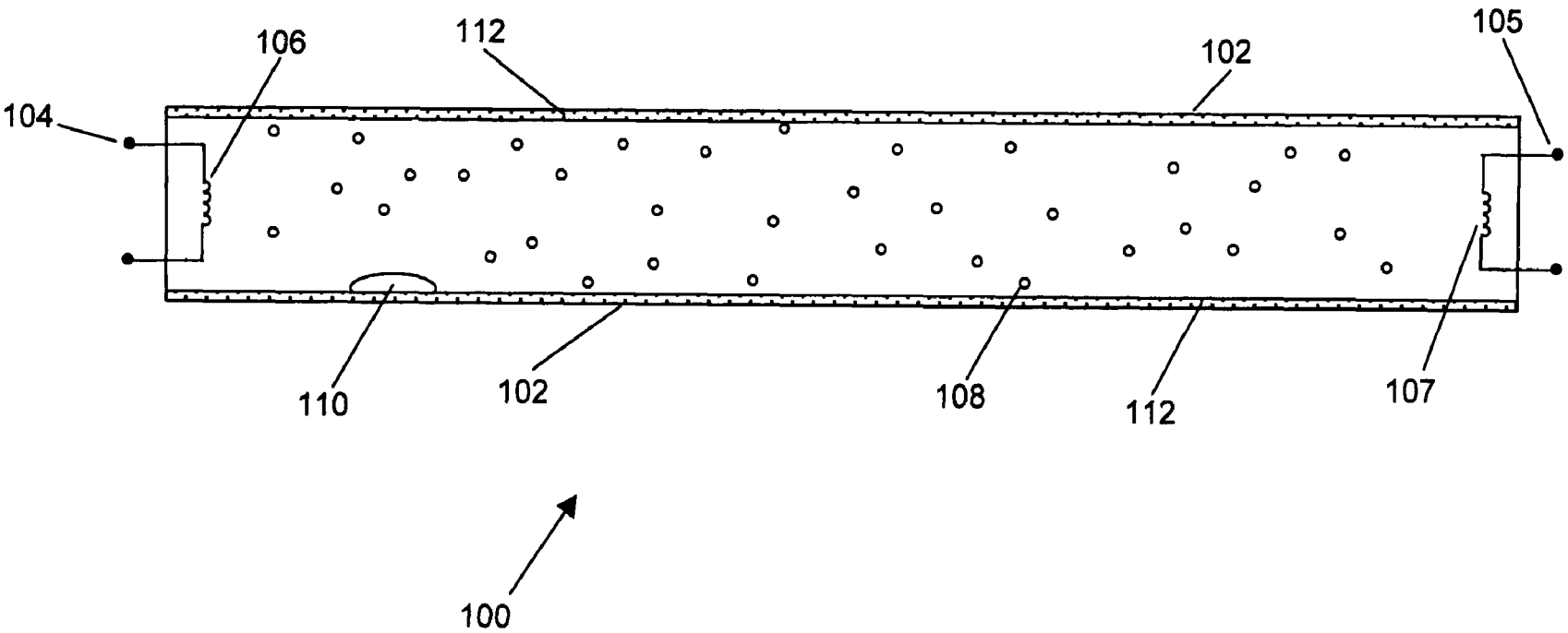
Fig. 1 (Prior Art)
FIG. 1 is a schematic cross-sectional representation of a conventional fluorescent light bulb in the off-state.

Generally, embodiments of the present invention receive dimming control information from a conventional incandescent dimmer control circuit, and generate the necessary control signals to provide dimming functionality for a fluorescent light. In typical embodiments, a compact fluorescent light having ballast and control circuitry disposed within its screw base, is fitted by the screw base into a conventional incandescent light socket, where that light socket is coupled to a conventional incandescent dimmer control circuit. In operation of these typical embodiments, the incandescent dimmer control information is used in the process of generating signals for providing dimmer functionality for the compact fluorescent light.

In addition to the illustrative embodiments described below in connection with fluorescent lights, the present invention is applicable more generally to low pressure arc lamps.

As is described in greater detail below, circuitry in accordance with the present invention provides drive signals to the fluorescent bulb which control brightness, or conversely dimming, by generating a pulse burst having a duration that is determinative of the perceived brightness of the bulb, and the pulse burst is immediately followed by a DC level of a first value. In the following cycle, subsequent to the pulse burst, a DC level of a second value is provided.

Reference herein to "one embodiment", "an embodiment", or similar formulations, means that a particular feature, structure, operation, or characteristic described in connection with the embodiment, is included in at least one embodiment of the present invention. Thus, the appearances of such phrases or formulations herein are not necessarily all referring to the same embodiment. Furthermore, various particular features, structures, operations, or characteristics may be combined in any suitable manner in one or more embodiments.

Terminology

Incandescence refers to emitting light as a result of heating.

Luminescence refers to cold body photon emission in response to stimuli including but not limited to electrical or chemical stimulation.

Fluorescence refers to photon emission at a first frequency in response to atomic or molecular absorption of a photon of a second frequency. As used herein, the second frequency is higher than the first frequency (e.g., an ultraviolet photon is absorbed by a phosphor, which in turn emits a visible light photon).

Tank circuit refers to a circuit having a capacitor and inductor coupled together in parallel. Such a circuit reaches its resonance frequency when the reactance of the capacitor and inductor are equal. The resonance frequency is generally expressed as:

$$f = \frac{1}{2\pi\sqrt{LC}}$$

where L is the inductance of the inductor and C is the capacitance of the capacitor.

In view of the respective principles of operation of incandescent lights and fluorescent lights, it will be appreciated that the mechanisms for controlling the dimming function in each type of light is different. Presented below is a description of the mechanisms for controlling dimming in each of the lighting types in view of their principles of operation. Further presented is a description of the principles, in accordance with the present invention, of receiving dimming control information from a conventional incandescent dimmer control circuit, and generating the necessary control signals to provide dimming functionality for a fluorescent light.

Conventional incandescent light bulbs include a resistive filament (e.g., tungsten) disposed within an enclosed volume, the resistive filament being connected to electrical contacts disposed on an external surface of the incandescent light bulb (i.e., the conductive surfaces of the screwbase of the light bulb). Typical household incandescent lights are coupled to an AC power supply, and a current passes through the resistive filament within a bulb, thereby heating the filament so that it glows white hot, and produces light. It is noted that the resistive filament presents a linear load to the AC power supply, and therefore incandescent light bulbs do not present a concern with respect to power factor. Unfortunately, a significant portion of the power consumed by the incandescent light bulb is converted into heat rather than light.

Fluorescent lights generally comprise a gas discharge tube operating in conjunction with some electronic control circuitry. Fluorescent lights produce visible light by generating, within a tube, ultraviolet photons that are absorbed by a phosphor coating on the tube wall, which in response emits photons in the visible light range. Although this high level description of fluorescent light operation is straightforward, the actual implementation and operation of a fluorescent light requires a number of components and steps that are not required to build and operate incandescent light bulbs. More particularly, as shown in FIG. 1, a fluorescent light 100 includes a sealed tube 102 to which are connected electrical terminals 104, 105, and within which are disposed a pair of electrodes 106, 107; electrodes 106, 107 being coupled respectively to the terminals 104, 105 as shown; a first gas 108 at low pressure; an amount of mercury 110, which is liquid at room temperature; and a phosphor coating 112 on the inner surface of the sealed tube. To produce the UV photons that cause the phosphor to emit visible light photons, a series of operations is performed. Current is passed through electrodes 106, 107 resulting in free electrons boiling off the electrodes, and further resulting in at least a portion of the liquid mercury transitioning to the gas state. It is noted that, in addition to acting as heaters, at least initially, electrodes 104, 105 are provided with a voltage difference between them so that the free electrons begin to move within sealed tube 102. Collisions between free electrons and gaseous mercury atoms create a cloud of ionized mercury (i.e., a plasma). The electrons and mercury ions are accelerated toward opposite electrodes, and in further collisions create additional pairs of electrons and mercury ions, as is well known, when energetic electrons drop into lower energy electron orbitals of the mercury atoms, energy is given off as UV photons. The polarity of the voltage difference between the electrodes is alternated at a predetermined frequency. It is noted that this predetermined frequency may be different for different phases of operation of the fluorescent light, such as during pre-heating of the electrodes, plasma ignition, and normal running frequency operation. As ions and free electrons accelerate in opposite directions, more collisions occur and more ions are generated. A consequence of this ion generation process is that the number of carriers increases as the current increases. In other words, subsequent to ignition of the mercury plasma, the resistance decreases as the current increases (sometimes referred to as negative resistance). If left unchecked, the chain reaction (i.e., more carriers being accelerated in the sealed tube leads to more collisions which leads to more carriers, and so on) can lead to adverse conditions including but not limited to overheating, and near short circuit over-currents that may result in tripped circuit breakers, blown fuses, and fires. To control the phenomenon of a run-away plasma, a "ballast" circuit is conventionally provided to ensure proper operation. Those skilled in the art and having the benefit of this disclosure will appreciate that the fluorescent light presents a non-linear load to the power system.

In view of the foregoing, it can be seen that the circuitry required to power and control a fluorescent light is significantly more complex than the simple on/off switch used for incandescent lights.

Figure 4:
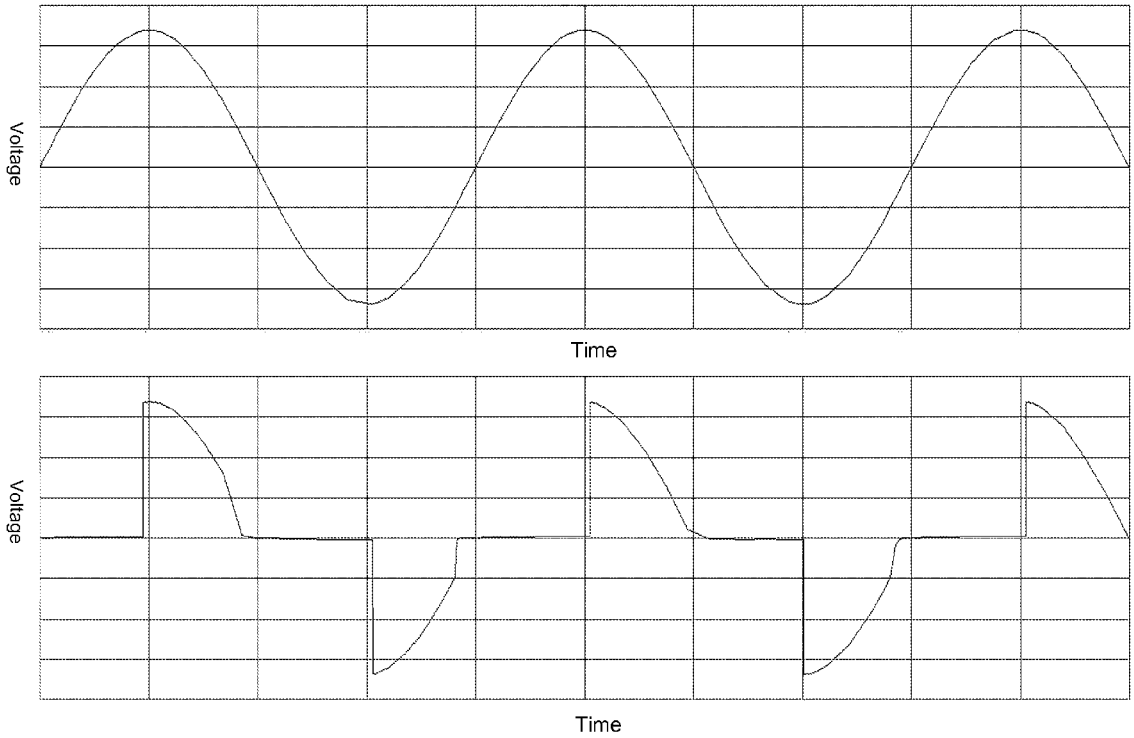
FIG. 4 is an oscillograph style drawing of an illustrative pair of input power and phase-cut modulated output of an incandescent dimmer control.

Conventional methods of dimming an incandescent light involve chopping the AC voltage sine wave. This is sometimes referred to as phase cutting. By chopping out part of the AC power waveform, less energy is delivered to the filament of the incandescent bulb. An illustrative pair of input power and phase-cut modulated dimmer control output can be seen in FIG. 4.

Conventional methods of dimming a fluorescent light involve directly adjusting the driving frequency via a separate voltage control input to a circuit that changes the driving frequency to the fluorescent bulb, through a series resonant circuit. A series RLC circuit boost the driving signal as that signal approaches resonance. The amount that the voltage is increased is limited by the Q of the circuit. By shifting the driving signal towards or away from resonance, the voltage across the bulb can be controlled, thereby controlling its brightness. So, even though compact fluorescent lights may be fitted into incandescent sockets, these fluorescent lights are not compatible with conventional incandescent dimmers, and therefore require a special dimming circuit to provide compatibility with incandescent style dimmers. Also, to set the normal running frequency, an external RC is used.

In various embodiments of the present invention, circuitry, which is compatible with the phase-cut AC power waveform of conventional incandescent dimmers, sets the characteristics of the drive signals for a fluorescent light based, at least in part, on sensing the duty cycle of the incoming AC supply waveform. In this way, existing incandescent lighting infrastructure may be preserved, and incandescent bulbs can be replaced with, for example, compact fluorescent lights equipped with a dimming circuit in accordance with the present invention. More particularly, instead of a continuous waveform with frequency control for brightness, various embodiments of the present invention provide a fixed frequency waveform that is driven using "pulse burst modulation". In this arrangement, a cycle time (or period), which is synchronized to the AC line voltage, is determined, the frequency of the drive pulses are adjusted to produce a current level in the bulb that results in a brightness corresponding to the desired 100% brightness level, and the resulting pulse period is stored. In order to operate the fluorescent bulb so as to produce a lower brightness level, i.e., dimming the bulb, the number of pulses provided during the cycle time is reduced. In this illustrative embodiment, a cycle time of dimmed brightness begins with a pulse burst having a frequency corresponding to 100% brightness, and the number of pulses being less than the number needed to fill the full cycle time. Following the pulse burst, a first DC level is provided. In the immediately succeeding cycle time, a second, and different, DC level is provided after the pulse burst. So, during dimming, the pulse waveform always averages to a net zero DC level; but the duration of the pulse train may vary to accommodate the desired brightness level, and alternate periods end with a DC high, then a DC low. It is noted that in order to keep the DC component of the driven waveform at zero, the pulse burst is ended in each successive cycle time as alternately high and low. That is, summing two time-wise adjacent cycles, equal high time and low time are obtained. It is further noted that in some embodiments, the pulsed portion of the pulse burst modulated waveform has a 50% duty cycle.

In typical embodiments of the present invention, the 100% brightness level is re-sampled at a predetermined time prior to the end of the pulse burst. In some embodiments, the predetermined time for this re-sampling operation is the last pulse or the second to last pulse of a given cycle.

In an alternative arrangement, rather than following a pulse burst with a DC level, a pulse burst of a second frequency is used to follow the original pulse burst in the cycle. In some dual frequency embodiments, rather than DC after the pulse burst, a second, higher frequency 50% duty cycle waveform is provided.

In various embodiments, the cycle time for the pulse burst modulation signals is synchronized with the AC power line frequency in order to remove drive changes due to Vdc modulation. Such line synchronization eliminates or reduces frequency beating of the line frequency and the pulse repetition rate, which effects may otherwise be visible in the light output of the fluorescent light bulb.

By providing a pulse burst modulation scheme, the fluorescent bulb may be viewed as being re-fired every cycle while dimming is taking place. Such re-firing may cause an over-current condition, and such over-current conditions may be similar to those resulting from an initial bulb firing, or plasma ignition. It will be appreciated that over-current conditions may tend to "wear-out", or prematurely age the bulb. In order to mitigate the wear-out effect caused by the large number of re-firings that occur when the bulb is operated in dimmed mode, some embodiments begin each pulse burst at a higher initial frequency (i.e., shorter pulse period), and then lower the frequency (i.e., increase the pulse period) over a predetermined number of pulses (a "frequency chirp"). In some embodiments, this frequency chirp may occur over, for example, the first 10 pulses. The present invention is not limited to a particular number of pulses over which the frequency chip occurs. Application of the frequency chirp to various embodiments of the present invention results in the over-current condition being insignificant, or non-existent. In an alternative embodiment, a determination of the magnitude of the peak current on re-firing is made, and the chirp is changed to result in no over-current condition.

Various conventional dimmer switches used for incandescent lighting require a current load to keep working. Prior art dimmable compact fluorescent light bulbs address this requirement by putting a resistor across the input line. Such prior art implementations consume a significant amount of total input power just to maintain the dimmer switch in the on state. In some embodiments of the present invention, the power loss of conventional designs is reduced by eliminating the resistor across the power input lines, and providing a pulsed current load after the bridge rectifier. In one embodiment, the pulsed current load has a 10% duty cycle when the line voltage is above 10V and a 100% duty cycle when the line voltage is below 10V. In a typical embodiment, the current level of the pulsed current load may be set with a resistor.

Figure 2:
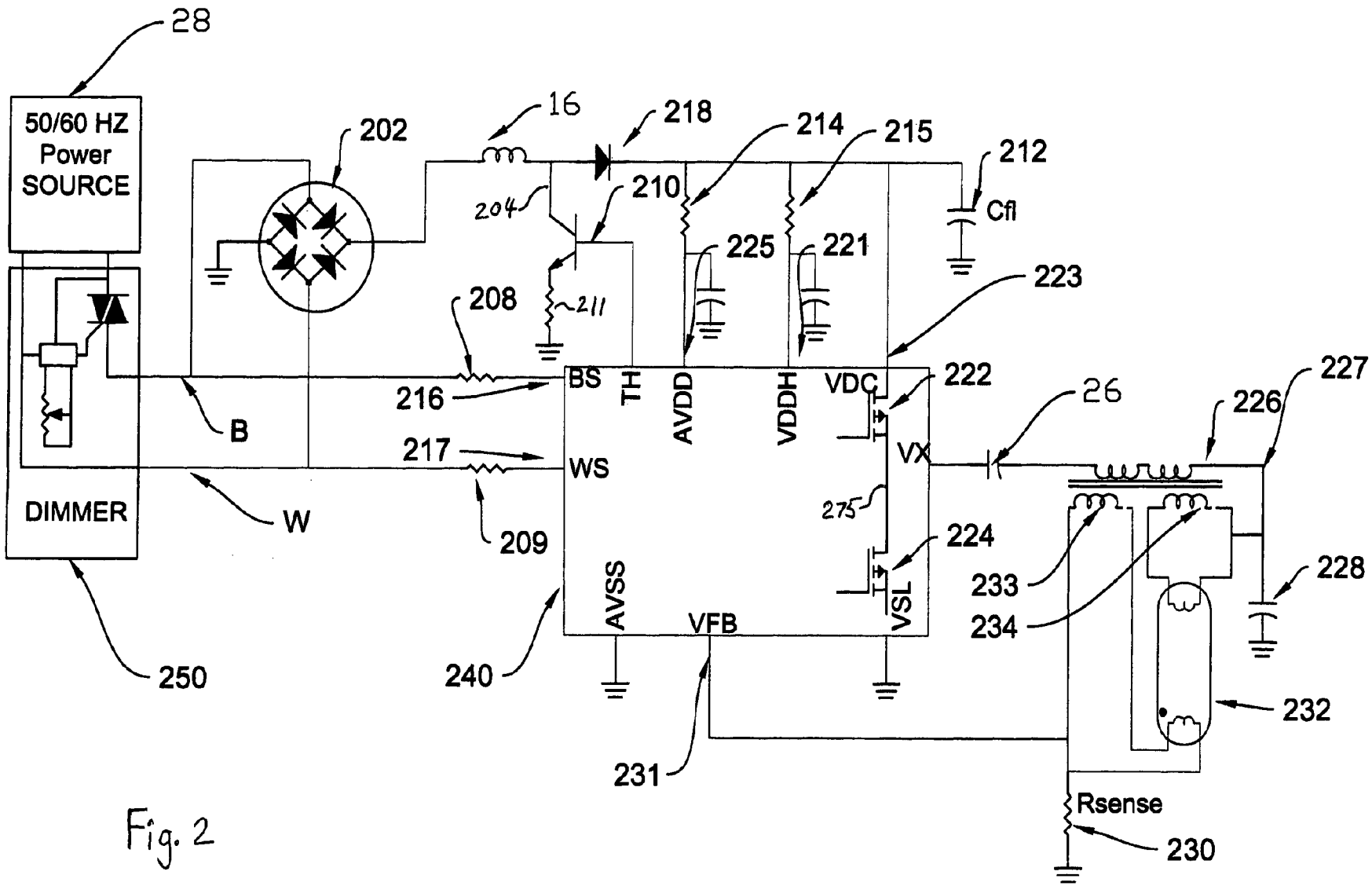
FIG. 2 is a schematic diagram of a circuit for driving a fluorescent light bulb in accordance with the present invention.

Referring to FIG. 2, a generalized circuit diagram suitable for describing various aspects of the present invention is provided. FIG. 2 shows a dimmer switch 250 for an incandescent light coupled, on an input side thereof, to an AC power source 28, and further coupled, on an output side thereof (i.e., output terminals B and W), to a rectifier 202, and to respective first terminals of resistors 208, 209. A second terminal of resistor 208 is coupled to terminal BS of integrated circuit 240, and a second terminal of resistor 209 is coupled to terminal WS of integrated circuit 240. In some embodiments, resistors 208, 209 each have a resistance of 500 KΩ. Integrated circuit 240, through terminals BS, WS, monitors the output waveform of dimmer control 250. The output of rectifier 202 is coupled to a first terminal of an inductor 16. The second terminal of inductor 16 is coupled to a node 204.

In this illustrative embodiment, the pulsed current load mentioned above is implemented with an NPN bipolar transistor 210 that is coupled by its collector to node 204, and by its emitter to a first terminal of resistor 211. The second terminal of resistor 211 is coupled to node ground. The base of transistor 210 is coupled to a signal TH which originates in integrated circuit 240. Circuitry within integrated circuit 240 provides the necessary control signal to the base of transistor 210 so that the pulsed current load has a 100% duty cycle when the line voltage is below 10V and 10% duty cycle when the line voltage is above 10 V. It is noted that alternative combinations of duty cycle and voltage thresholds may be used within the scope of the present invention, as long as the pulsed current load contributes a sufficient current draw to prevent the conventional incandescent dimmer from turning off for lack of a current load. In this illustrative embodiment, resistor 211 has a resistance of 80Ω.

Still referring to FIG. 2, a diode 218 is coupled anode-to-cathode between node 204 and node 223. A capacitor 212 is coupled between node 223 and ground. In this illustrative embodiment, capacitor 212 has a capacitance of 33 μF. As shown in the figure, a first series RC includes a resistor 214 coupled between node 223 and an intermediate node 225. Intermediate node 225 is coupled terminal AVDD of integrated circuit 240 and further coupled to a capacitor to ground. A second series RC includes a resistor 215 coupled between node 223 and an intermediate node 221. Intermediate node 221 is coupled to terminal VDDH of integrated circuit 240, and further coupled to a capacitor to ground as shown in the figure. Also within integrated circuit 240, in this illustrative embodiment, a PFET 222 is coupled source-to-drain between node 223 and a node 275. An NFET 224 is coupled drain-to-source between node 275 and ground. The gate terminals of PFET 222 and NFET 224 are coupled to control circuitry not shown in FIG. 2, but which originate within integrated circuit 240. That control circuitry determines, among other things, the pulse burst modulation used for various phases of operation of the fluorescent bulb 232. A capacitor 26 is coupled between output VX of integrated circuit 240 and a first terminal of a transformer 226. The primary of transformer 226 is coupled between capacitor 26 and a node 227. A capacitor 228 is coupled between node 227 and ground. A resistor 230 is coupled between a node 231 and ground. A first secondary 233 of transformer 226, and a second secondary 234 of transformer 226 are used to deliver power to fluorescent bulb 232. Fluorescent bulb 232 is coupled to nodes 227 and 231 as shown. It will be appreciated that integrated circuit 240 further includes various logic circuitry for counting, dividing, logically combining signals, and otherwise conducting well understood digital operations to provide As noted above, embodiments of the present invention provide the dimming function, among other functions, for a compact fluorescent light bulb, that is coupled to an incandescent dimmer control. The operation of such an illustrative circuit in accordance with the present invention is described below. A clock signal, RCK, is generated from a stable or unstable source that is higher than the maximum frequency needed to drive the fluorescent bulb at its dimmest point or during startup. It is noted that RCK may be generated as an output of a free-running ring oscillator.

Figure 3A:
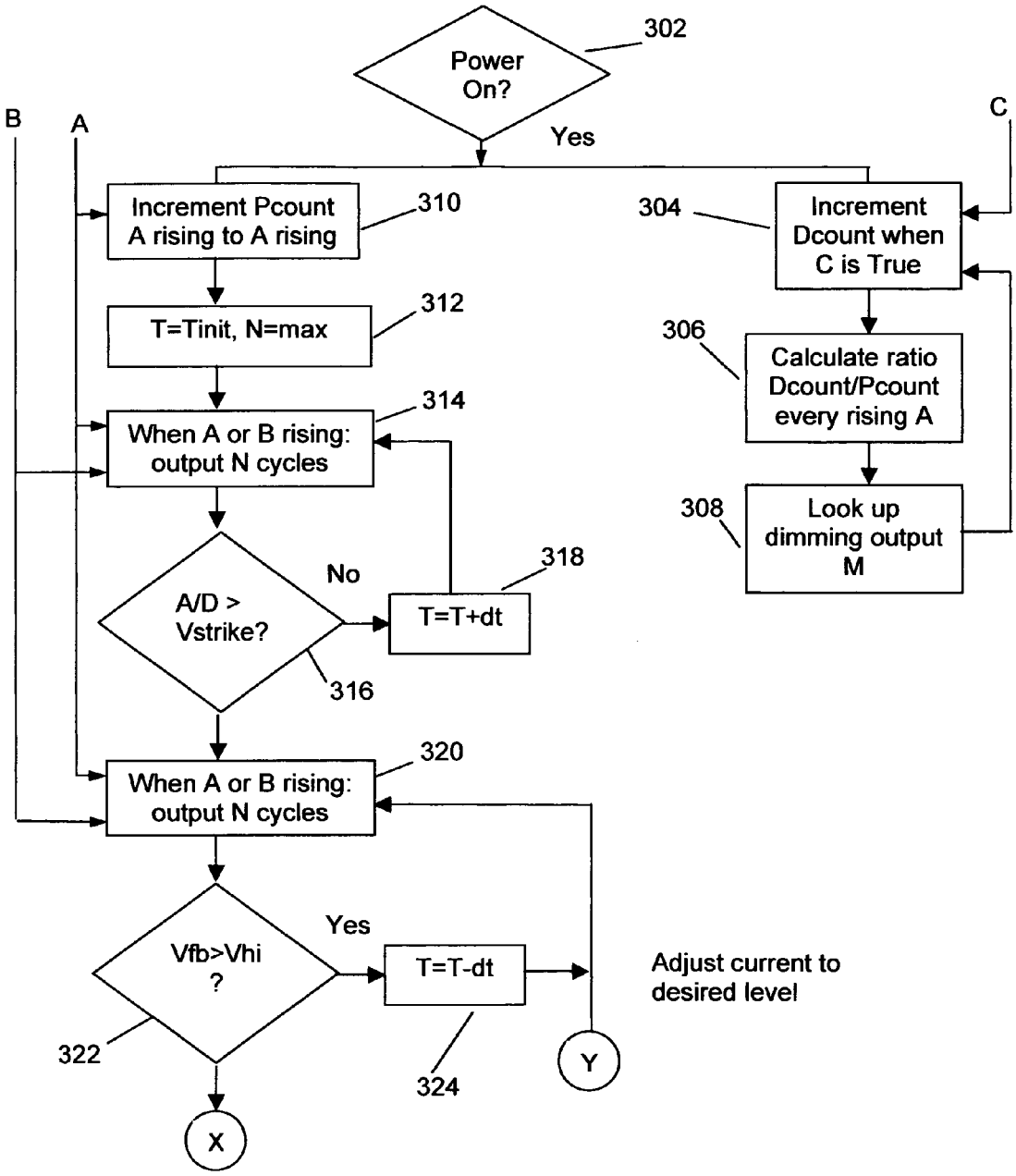
FIGS. 3A-3B provide a flow diagram for an illustrative method of operating a fluorescent bulb in accordance with the present invention.
Figure 3B:
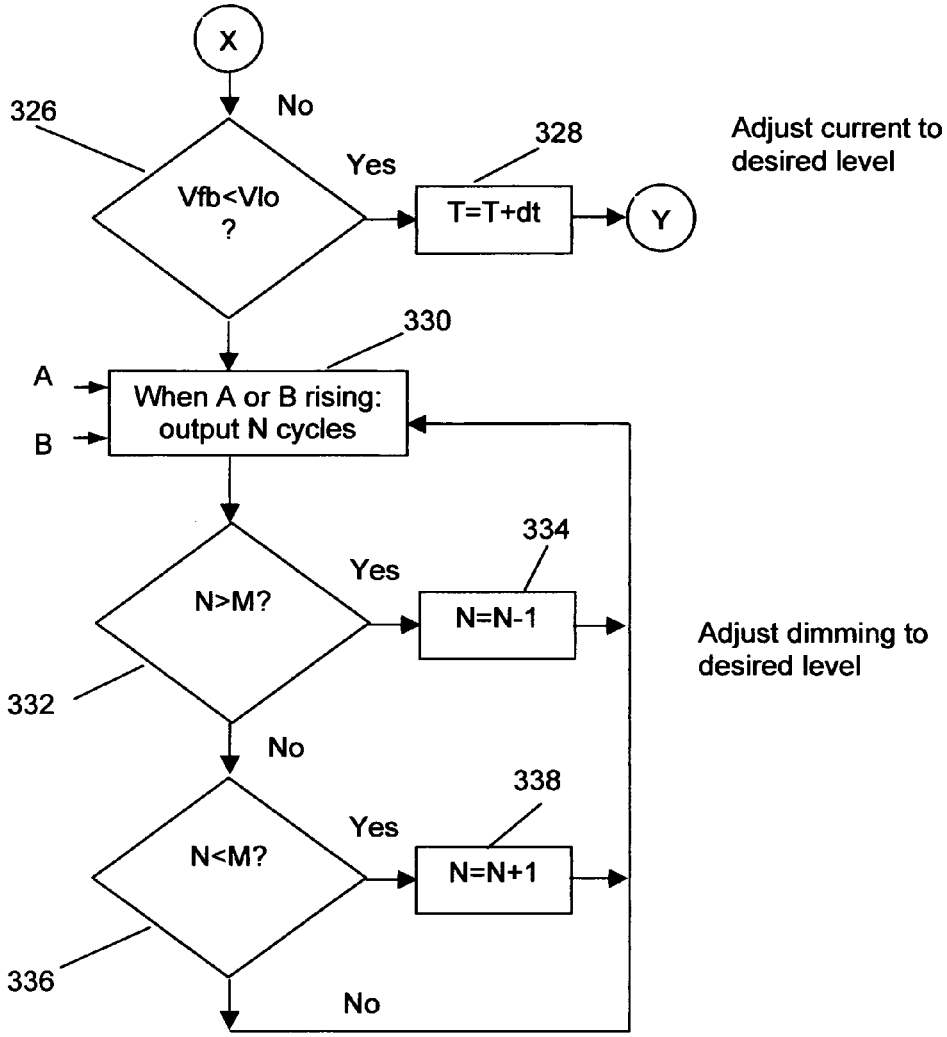

Referring generally to FIGS. 3A-3B, an illustrative process for operating a fluorescent light in accordance with the present invention is described. In FIGS. 3A-3B several variable and signal names are used. The definitions of those variable and signal names are: A=true when V>+40; B=true when V<−40; C=true when V>+10 or V<−10 (i.e., |V|>10); N=# of output switch cycles; M =requested dimming level; T=output switch period; and Vfb=Analog-to-Digital value at a specific cycle (alternatively a comparator is used rather than an A/D). Referring particularly to FIG. 3A, initially, at 302, a determination is made as to whether power is on, or alternatively, whether of power-on reset sequence has been completed. If the power-on sequence has not yet been completed then the process waits for the completion of the power-on sequence. Those skilled in the art and having the benefit of the present disclosure will recognize that proper operation requires that acceptable levels of power supply voltage be reached and that various logical nodes should be set (or reset) to appropriate initial conditions. Once power levels are proper and any required initialization is completed, then concurrently at 304 a counter is incremented by each occurrence of the reference clock during a time period corresponding to |V| being greater than a predetermined value, 10 volts in this illustrative embodiment, the value in the counter is referred to Dcount; and at 310 a counter is incremented by each occurrence of the reference clock for a period of time substantially equal to the period of the AC power waveform, the value in the counter is referred to as Pcount. Pcount represents the number of reference clocks in one AC power line period, and Dcount represents the number of reference clocks in one AC power line period in which the line voltage is away from the zero crossing by a predetermined amount. At 306 calculate the ratio of Dcount/Pcount at the rising edge of signal A (where A is true when V>+40V). At 308, using the value determined at 306, look up a dimming output value, M.

Still referring to FIG. 3A, at 312, initialize variables, such as T (the output switch period) being set to an initial value, and N being set to a maximum value. In this way, the pulse train that controls the driver transistors coupled to the tank circuit that provides voltage to the fluorescent bulb, starts at the high end of its frequency range and lasts for entire length of the cycle time corresponding to 100% brightness. At 314, if either of signals A or B are rising then N switch cycles are generated. At 316, determine whether the plasma ignition voltage has been reached. If the plasma ignition voltage has not been reached, then at 318, increase the period of the pulses (i.e., lower the frequency) and return to block 314 to try igniting the plasma again. If the plasma ignition voltage has been reached, then at 320 generate N switch cycles. During the time that the process loops between steps 314, 316, and 318, the filaments and gas are pre-heating. This loop is slow enough, and the lamp current high enough, to accelerate the initial pre-heating of the lamp such that the actual warm-up time of the lamp is greatly reduced. This is an inherent problem with fluorescent lamps that it can take several minutes of operation to reach 100% brightness. At this point the process engages in several steps to adjust bulb current to the desired level. As can be seen in FIGS. 3A and 3B, and in blocks 322, 324, 326 and 328, a voltage that corresponds to the bulb current is measured and converted from an analog value to digital value; the digital value is compared to reference values, and if the voltage is too high then the pulse period is decreased (increasing the frequency), whereas if the voltage is too low then the pulse period is increased (decreasing the frequency). Once the voltage, which represents the bulb current, is within the predetermined limits, control passes to 330 and when either signals A or B are rising, then N switch cycles are generated. At this point the process engages in several steps to adjust the brightness of the bulb to a desired level. Of course, if there is no dimming signal then the bulb will continue to operate at the 100% brightness level. However, if a dimming request has come from the dimmer control, then a value corresponding to the number of pulses to be generated was already looked up at block 308. In steps 332, 334, 336, and 338, the number of pulses being generated is compared to the number determined by the look up operation at 308 and the pulse count is incremented or decremented until a match occurs. In an alternative process, steps 332, 334, 336, and 338 are replaced with one step in which N is simply set equal to M.

One illustrative method of operating a fluorescent light bulb, includes receiving a phase-cut AC power waveform from a socket coupled to an incandescent dimmer switch; determining a dimming level based, at least in part, on a ratio of an amount of time the absolute value of the AC power waveform is greater than a predetermined threshold value to the total period of the AC power waveform; and generating a pulse burst modulated driving signal; wherein the pulse burst modulated driving signal comprises a first series of pulses in a first time-continuous portion of a predetermined period, the duration of the first series being less than the predetermined period.

Another embodiment further includes determining whether the current in the fluorescent bulb is less than a pre-determined amount, and if the determination is affirmative, then shutting down at least one output driver transistor.

An alternative method of operating a fluorescent light bulb, includes receiving an AC power waveform; completing a power-on reset sequence; determining a dimming level based, at least in part, on a ratio of an amount of time the absolute value of the AC power waveform is greater than a predetermined threshold value to the total period of the AC power waveform; and pre-heating a gas contained within the fluorescent light bulb; generating a first number of pulses having a first duty cycle and a first frequency, the first number of generated pulses providing a total duration that is substantially equal to the period of the AC power waveform; modifying the first frequency of the pulses until a plasma is ignited in the fluorescent light bulb; and reducing the number of pulses in each cycle, based, at least in part, on the determined dimming level. It is noted that, in some embodiments, the reduced number is selected based, at least in part, to yield a dimming profile equivalent to that of an incandescent lamp that received the same input from the dimmer control.

It will be appreciated that various alternative or additional functions can be incorporated with the circuitry of the present invention. In one illustrative alternative embodiment, wireless communication circuitry (e.g., Bluetooth, Wi-Fi) is included with the fluorescent light control circuitry of the present invention such that commands may be received from a remote controller. In this way, a compact fluorescent light may be installed in a conventional incandescent light socket and still provide dimming functionality without having to physically install dimmer switches in the wall. This may be particularly useful for consumers who desire the dimming function but are prohibited from making physical wiring changes by rental or lease agreements.

It will be further appreciated that various logical functions described herein may be implemented in any suitable manner, including but not limited to, hardware, software, or combinations thereof. Further various functions may be implemented with specific hardware, or by generalized hardware which is responsive to stored instructions (e.g., a microcontroller).

CONCLUSION

It is to be understood that the present invention is not limited to the embodiments described above, but encompasses any and all embodiments within the scope of the subjoined Claims and their equivalents.

What is claimed is:

1. A method of operating a fluorescent light bulb, comprising:

receiving a phase-cut AC power waveform from a socket coupled to an incandescent dimmer switch;

determining a dimming level based, at least in part, on a ratio of an amount of time the absolute value of the phase-cut AC power waveform is greater than a predetermined threshold value to the total period of the phase-cut AC power waveform; and generating a pulse burst modulated driving signal;

wherein the pulse burst modulated driving signal comprises a first series of pulses in a first time-continuous portion of a predetermined period, the duration of the first series of pulses being less than the predetermined period.

2. The method of claim 1, wherein the first series of pulses are synchronized with the phase-cut AC power waveform.

3. The method of claim 2, wherein the pulse burst modulated driving signal further comprises a first DC level in the remaining portion of the predetermined period.

4. The method of claim 2, wherein the pulse burst modulated driving signal further comprises a second series of pulses in the remaining portion of the predetermined period, the second series of pulses having a different frequency than the first series of pulses.

5. The method of claim 2, further comprising re-sampling the 100% brightness level at a predetermined time prior to the end of the pulse burst modulating driving signal.

6. The method of claim 1, wherein in two time-wise adjacent periods an amount of high time and low time are substantially equal.

7. The method of claim 1, wherein determining the dimming level comprises counting a number of reference clocks that correspond to the total period of the phase-cut AC power waveform; and counting a number of reference clocks that correspond to an amount of time that a line voltage is away from its zero crossing by a predetermined amount.

8. The method of claim 1, further comprising determining whether a current in the fluorescent bulb is less than a predetermined amount, and if the determination is affirmative, then shutting down at least one output driver transistor.

9. The method of claim 1, further comprising operating a pulsed current load for the incandescent dimmer switch.

10. A method of operating a fluorescent light bulb, comprising:

receiving an AC power waveform;

completing a power-on reset sequence;

determining a dimming level based, at least in part, on a ratio of an amount of time the absolute value of the AC power waveform is greater than a predetermined threshold value to the total period of the AC power waveform;

pre-heating a gas contained within the fluorescent light bulb;

generating a first number of pulses having a first duty cycle and a first frequency, the first number of generated pulses providing a total duration that is substantially equal to the period of the AC power waveform;

modifying the first frequency of the pulses until a plasma is ignited in the fluorescent light bulb; and generating a second number of pulses in each cycle, based, at least in part, on the determined dimming level, the second number of pulses less than the first number of pulses.

11. The method of claim 10, wherein the fluorescent light bulb is a compact fluorescent light bulb.

12. The method of claim 11, further comprising determining whether the current in the fluorescent bulb is less than a pre-determined amount, and if the determination is affirmative, then shutting down at least one output driver transistor.

13. The method of claim 11, wherein the first number of pulses are synchronized to the AC power waveform.

14. The method of claim 10, further comprising operating a pulsed current load for an incandescent dimmer switch.

15. The method of claim 10, further comprising generating, subsequent to generating the reduced number of first pulses, a series of second pulses, wherein the second pulses have a higher frequency than the first pulses.

16. The method of claim 10, wherein the second number of pulses is selected based, at least in part, to yield a dimming profile equivalent to that of an incandescent lamp.

* * * * *